United States Patent [19]

Mitchell et al.

[11] Patent Number: 4,957,424

[45] Date of Patent: Sep. 18, 1990

[54] CONCRETE PIPE MAKING MACHINE

[75] Inventors: William J. Mitchell, Charles City; Navarro T. Fosse, Nashua, both of Iowa

[73] Assignee: Hydrotile Machinery Company, Nashua, Iowa

[21] Appl. No.: 322,175

[22] Filed: Mar. 13, 1989

[51] Int. Cl.[5] ..... B28B 21/28

[52] U.S. Cl. ..... 425/145; 425/262; 425/424; 425/427; 425/456; 425/457

[58] Field of Search ..... 425/145, 147, 162, 262, 425/424, 456, 425–427, 457; 264/72, 70, 71

[56] References Cited

U.S. PATENT DOCUMENTS

| | | | |
|---|---|---|---|
| 2,926,411 | 3/1960 | Steiro | 425/424 |
| 3,095,628 | 7/1963 | Norton et al. | 425/262 |
| 3,096,556 | 7/1963 | Woods | 425/262 |
| 3,141,222 | 7/1964 | Steiro | 425/262 |
| 3,276,091 | 10/1966 | Pausch | 425/262 |
| 3,551,968 | 1/1971 | Fosse et al. | 425/162 |
| 3,649,727 | 3/1972 | Gauger | 264/312 X |
| 3,655,842 | 4/1972 | Trautner | 264/72 |
| 3,689,967 | 9/1972 | Hurst | 29/116.1 |
| 3,752,626 | 8/1973 | Trautner et al. | 425/262 |
| 3,922,133 | 11/1975 | Crawford et al. | 425/262 |
| 3,948,354 | 4/1976 | Fosse et al. | 425/432 X |
| 4,079,500 | 3/1978 | Tolliver | 264/259 X |
| 4,131,408 | 12/1978 | Schulster et al. | 425/410 |
| 4,253,814 | 3/1981 | Christian | 425/150 |
| 4,340,553 | 7/1982 | Fosse | 264/40.7 |
| 4,400,149 | 8/1983 | Toffolon et al. | 425/262 |
| 4,406,605 | 9/1983 | Hand | 425/262 X |
| 4,407,648 | 10/1983 | Fosse | 425/457 |
| 4,540,539 | 9/1985 | Crawford et al. | 264/269 |
| 4,639,342 | 1/1987 | Adly | 264/40.1 |
| 4,690,631 | 9/1987 | Haddy | 425/262 |

*Primary Examiner*—Richard L. Chiesa
*Attorney, Agent, or Firm*—Burd, Bartz & Gutenkauf

[57] ABSTRACT

A concrete pipe making machine having a combined vibrating core and counter rotating packerhead assembly is used with a mold to prepack and vibrate concrete within the mold to produce concrete pipe. A controller is programmed in response to packing force of the packerhead assembly to control the discharge of concrete into the mold and the lift speed of the core and packerhead assembly to produce concrete pipe having uniform density through out the length of the pipe.

48 Claims, 6 Drawing Sheets

CONCRETE PIPE MAKING MACHINE

TECHNICAL FIELD

The invention is in the field of concrete product making machines and controls for operating the machines. The particular concrete product making machines use combined packerhead and vibration processes to make concrete pipe. These machines have packerheads to prepack concrete in molds and cores that are vibrated as they move up into molds to form and densify the prepacked concrete into concrete pipes.

BACKGROUND OF INVENTION

There are two general types of concrete pipe making machines known as packerhead and vibrating core machines. Packerhead concrete pipe making machines have rotating packerheads that are moved up into molds to form concrete pipes. An example of a packerhead concrete pipe making machine having a counter rotating packerhead is shown by Fosse in U.S. Pat. No. 4,407,648. The vibrating core concrete pipe making machines have generally cylindrical cores accommodating vibrators. The cores are moved up into molds to form concrete pipes. The vibrators operate to consolidate and densify the concrete in the molds during the forming of the pipes. The vibrating core concrete pipe making machine is generally slower in operation than a packerhead concrete pipe making machine. An example of a vibrating core concrete pipe making machine is shown by Fosse et al in U.S. Pat. No. 3,948,354.

The vibration process is a relativly slow method of making concrete pipe. However, the vibration process produces denser pipes and does not twist the cages. The packerhead process is fast in operation and can result in reinforcing cage twist. The packerhead process produces concrete pipes having smooth outside and inside finishes. The outside finish of pipes made by vibrations process is not smooth due to a tendancy of air pockets to collect between the outside walls of the pipes and the molds.

PRIOR ART

Steiro in U.S. Pat. Nos. 2,926,411 and 3,141,222 discloses concrete pipe making machines that have cores located within cylindrical molds. When the cores are up in the molds, concrete is discharged into the annular spaces between the cores and molds. A distributor mounted on top of the core is used in U.S. Pat. No. 3,141,222 to move concrete into the mold. The core is reciprocated and vibrated to trowel the inner surface of the pipe and settle the concrete in the mold. Norton et al in U.S. Pat. No. 3,095,628; Trauter in U.S. Pat. No. 3,655,842 and Christian in U.S. Pat. No. 4,253,814 disclose concrete pipe making machines having cores and packerheads that are concurrently used to make concrete pipe. The packerheads are connected to lift structures located above the molds and are rotated with power units mounted on these structures. The cores are moved up into the molds with separate lift cylinders. Fosse et al in U.S. Pat. No. 3,948,354 and Schulster in U.S. Pat. No. 4,131,408 disclosure concrete pipe making machines having vibrating cores that move up into molds to form the pipe and densify the concrete. Distributor arms rotated above the cores move concrete into the annular spaces between the cores and mold as the cores are moved up into the molds.

SUMMARY OF INVENTION

The machine for making concrete product, such as a concrete pipe, of the invention utilizes concurrent packerhead and vibration processes to form and densify concrete into pipe. The machine has a generally upright core supporting a vibrator used to vibrate the side wall of the core to subject the concrete in the mold around the core to vibrations which densify the concrete. A counter rotating packerhead assembly is mounted on top of the core and functions to prepack the concrete into a configuration that generally has a cylindrical interior before it is subjected to vibrations generated by the core. The prepacking of the concrete by the counter rotating packerhead assembly produces pipe having a smooth finish on its outside surface as the concrete is forced against the mold wall to preclude the entrapment of air pockets adjacent the mold. The prepacking of the concrete before it is subjected to the vibrations of the core reduces the amount of time required to vibrate the concrete to produce a finished concrete pipe. The combination of the packerhead and vibrating processes employed in the machine for making pipe produces concrete pipe that has substantially the same density as pipes made on vibration machine with the same quality inside and outside surface finish as concrete pipes made on a conventional packerhead machine.

The preferred embodiment of the machine for making a cylindrical concrete pipe uses an upright mold having a generally cylindrical mold side wall surrounding a mold chamber. A generally cylindrical reinforcing wire cage is located within the mold chamber adjacent the mold side wall to provide reinforcement for the finished concrete pipe. Concrete pipe can also be made without reinforcing structure, such as a cylindrical wire cage, with the machines herein described. A turntable having an opening supports the mold in general vertical alignment with the opening. A stationary floor can be used to support the mold. The concrete pipe is formed with a vibrating core and counter rotating packerhead assembly having two roller heads that are initially positioned below the turntable in the vertical alignment with the opening. The core is supported on a lift or elevator that moves the packerhead assembly and core up and down into and out of the mold chamber to make concrete pipe. A conveyer located above the mold operates to discharge concrete into the mold chamber above the counter rotating packerhead assembly which operates to distribute and prepack the concrete in the mold chamber during its upward movement in the mold chamber before the concrete is subjected to the forming and densification action of the vibrating core. The core has a cylindrical side wall that supports a vibrator operable to vibrate the side wall and thereby subject the concrete around the core to vibrations as the core moves upwardly in the mold chamber. The vibrations enhance the densification of the concrete that has been prepacked by the counter rotating packerhead assembly. The counter rotating packerhead assembly located immediately above the core has an upper roller head and a lower roller head. Each roller head has a plurality of circumferentially arranged rollers that are rotatably mounted for rotation about separate axes generally parallel to the upright axis of the core. The rollers have outer circumferential portions that move along a circular path usually having a diameter smaller than the diameter of the core side wall whereby the rollers prepack the concrete adjacent the mold to a thickness greater than thickness of the concrete in the space between the core side wall and the mold as the rollers move along the circular path. A first drive located within the core chamber turns the upper roller head in a first circumferential direction about the upright axis of the core. A second drive located within the core turns the lower head in a second circumferential direction opposite the first circumferential direction about the upright axis of the core. The oppositely turning roller heads produce opposite working or packing forces on the concrete that generally cancel each other thereby placing a minimum of torsional or twisting force on the reinforcing cage.

The machine for making concrete pipe has controls for sensing the power used to rotate the packerhead assembly and generating a signal representing the sensed power. The sensed power can be the power used to rotate either the upper roller head or lower roller head or both the upper and lower roller heads. Preferrably, the power used by the first drive to rotate the upper roller head is sensed and used to control the operating speed of the conveyer. A computer controller is programed to be responsive to the signal to control the speed of operation of the conveyer thereby control the rate at which concrete is discharged by the conveyer into the mold chamber above the counter rotating packerhead assembly. When the amount of concrete above the counter rotating packerhead assembly increases, the amount of torque or power required to rotate one or both roller heads increases. The increase in torque is proportional to the signal supplied to the controller. The controller will then actuate the drive system for the conveyer to slow the speed of operation of the conveyer and thereby reduce the amount of concrete that is discharged into the mold chamber. When the amount of concrete above the counter rotating packerhead assembly decreases, the speed of the conveyer increases as the amount of torque or power required to rotate the packerhead assemly decreases. The decrease in the torque to rotate the upper packerhead assembly is sensed and causes a signal to be sent to the controller at which in turn increases the speed of operation of the conveyer and thereby increasing the amount of concrete that is discharged into the mold. In this manner, the level of the concrete above the counter rotating packerhead assembly is maintained so that the packerhead assembly has a substantually constant prepacking force on the concrete that results in minimum twisting forces on the reinforcing cage and a continuous supply of concrete to the packerhead assembly.

The core and counter rotating packerhead assembly mounted thereon are moved up into the mold chamber at a selected speed that is responsive to the signal representing the sensed power of the first drive for turning the packerhead assembly. The sensed signal is used to adjust both the operating speed of the conveyer and the speed of movement of the core and packerhead assembly up into the mold to maintain a substantially constant packing force on the concrete being prepacked by the packerhead assembly. The power lift for the core and counter rotating packerhead assembly utilizes a hydraulic cylinder to vertically move the core and the counter rotating packerhead assembly. Hydraulic fluid under pressure is supplied to the cylinders with a pump controlled with a valve. The operation of the valve is controlled with the controller that utilizes the signal representative of the sensed power used by the drive for turning the packerhead assembly, such as the upper roller head. The vibrator mounted on the core wall has a motor that operates the vibrating structure at selected speeds to vary frequency of the vibrations that are generated. A control connected to the pump operates to vary the speed of the vibrator motor as the core moves up into the mold chamber. This increases the vibrations which are partially dampened by the mass of the concrete surrounding the core as the length of the pipe increases. The control can be operated so that the speed of the vibrator motor is fixed or substantially constant during the making of concrete pipe.

DESCRIPTION OF PREFERRED EMBODIMENTS

Figure 1:
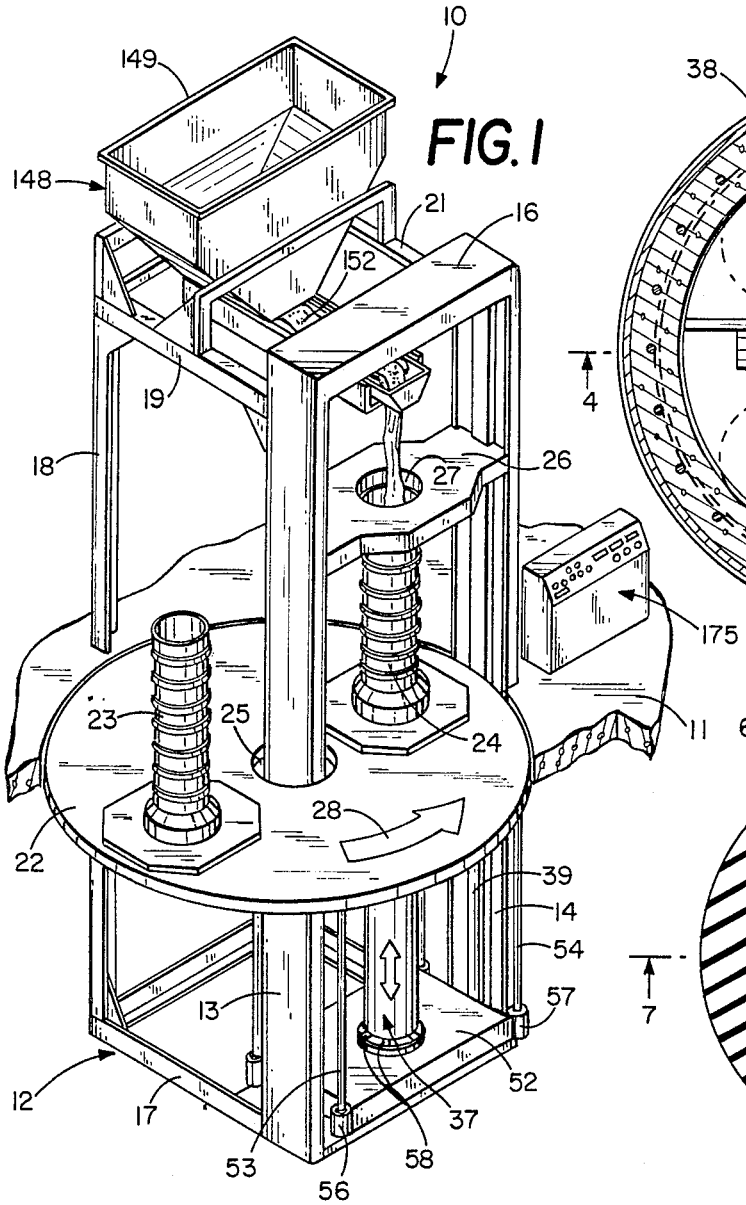
FIG. 1 is a perspective view of a concrete pipe making machine according to the invention.
Figure 3:
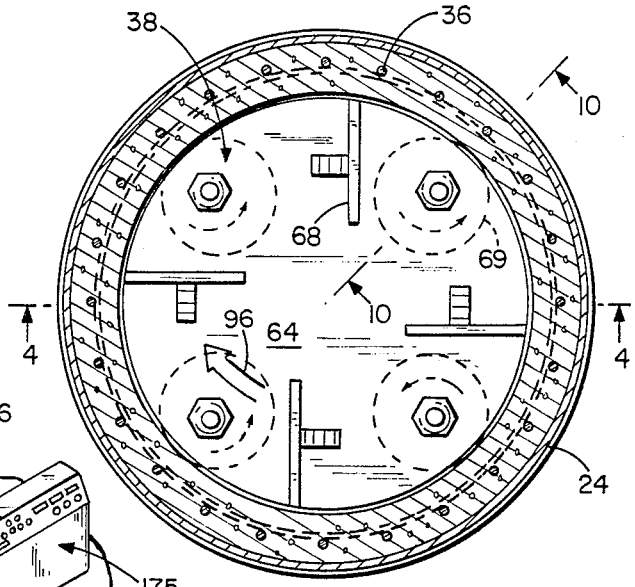
FIG. 3 is an enlarged sectional view taken along the line 3—3 of FIG. 2.

Referring to FIG. 1, there shown a concrete pipe making machine, indicated generally at 10, for making cylindrical concrete product and pipes associated with a generally horizontal floor 11. Machine 10 is herein described for making a single concrete pipe within a mold. Two or more concrete pipes can be simultanously made by duplicating the pipe forming counter rotating packerhead assembly and core structure of the machine.

Machine 10 has an upright frame indicated generally at 12 comprising a pair of upright front members 13 and 14 joined together with a top beam 16 and a generally rectangular base 17. A pair of upright rear members 18 extended upwardly from base 17 are secured to upper portions of front members 13 and 14 with beams 19 and 21. A circular turntable 22 has a central hole 25 that accomodates front frame member 13. Turntable 22 is movably supported on support structures, such as rollers (not shown) for sequential rotation about an upright axis. A drive system (not shown) rotates turntable 22 in the direction of the arrow 28 to sequentially move molds or jackets 23 and 24 between an off-loading station and a pipe making station. Mold 23 is located in the off mold station where it can be removed from turntable 22 and replaced with another mold. Mold 24 is located in the pipe making station. The machine can have a fixed platform or floor supporting the mold in lieu of turntable 22. The mold along with a completed pipe can be removed from the concrete pipe making location of the platform and replaced with another mold to make a second concrete pipe.

Molds 23 and 24 are cylindrical metal members, commonly known as jackets, that shape the outside surface of concrete pipe 100. Mold 24 is mounted on the top of turntable 22 and extends upwardly to a top table or concrete feeding platform 26. Platform 26 has a central hole 27 for allowing concrete to be delivered into the chamber of mold 24. Platform 26 is provided with a concrete feeding device 27 as shown in U.S. Pat. No. 3,551,968, incorporated herein by reference.

Figure 2:
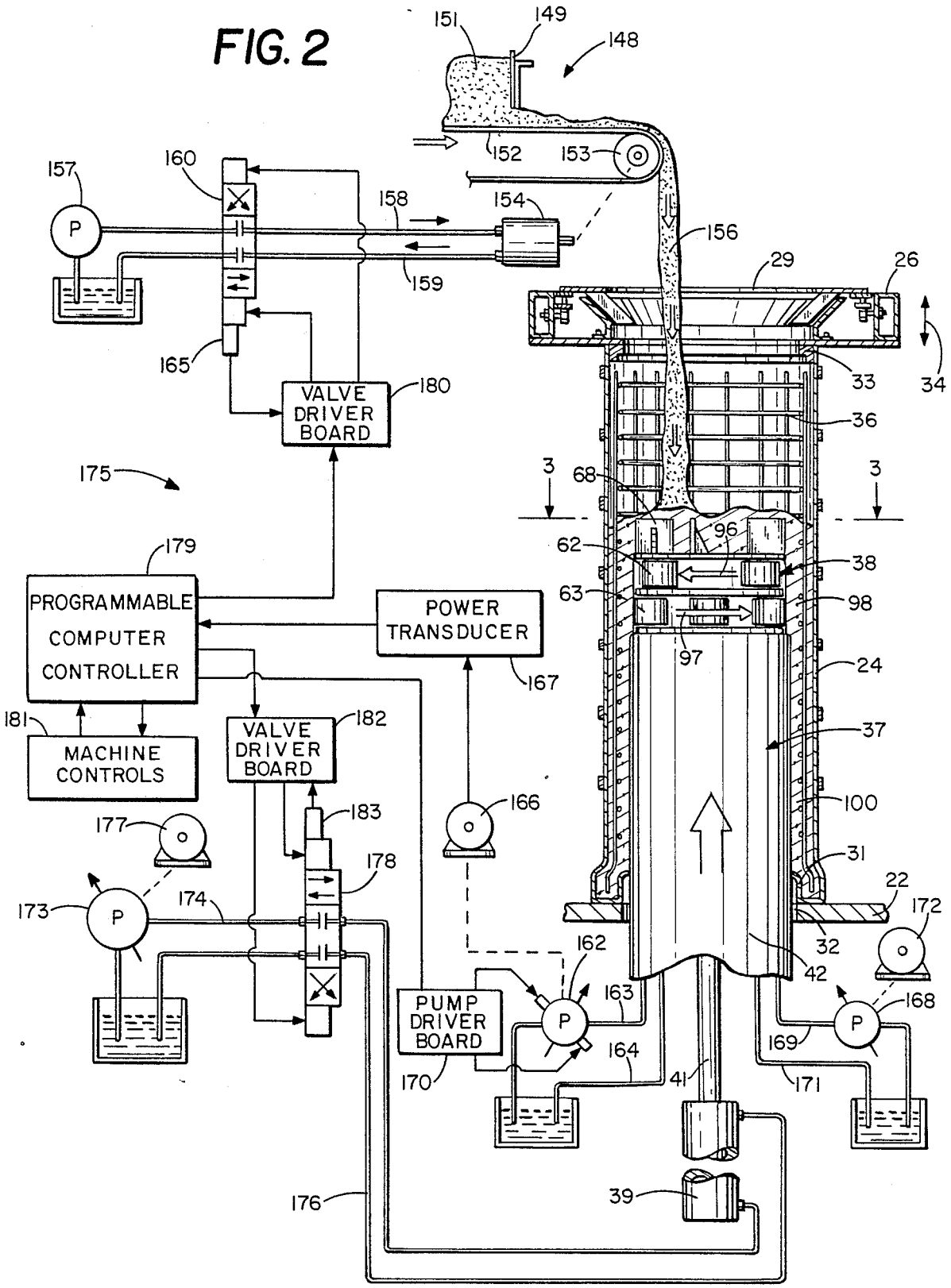
FIG. 2 is a diagramatic view of the vibrating core, counter rotating roller head, conveyer drive system, and concrete feed control of the concrete pipe making machine of FIG. 1.

Referring to FIG. 2, mold 24 has an enlarged annular lower end or bell that surrounds a pallet 31 which shapes the bell of the concrete pipe. An alternate mold having a straight cylindrical wall without an enlarged lower end or bell can be used with the machine to make concrete pipe. Pallet 31 is concentricilly positioned about a hole 32 in turntable 22. The upper end of mold 24 surrounds a stepped ring 33 attached to feeding platform 26. Platform 26 is movable mounted on frame members 13 and 14 with hydraulic cylinders (not shown) and can be raised and lowered as indicated by arrow 34 relative to the top of mold 24 to permit mold 24 to be indexed to the off bearing position. A cylindrical cage 36 comprising a plurality of connected circular and vertical reinforcing rods extends between pallet 31 and ring 33 adjacent the inside of mold 24. An example of a wire cage for a reinforced concrete pipe is disclosed by Tolliver in U.S. Pat. No. 4,079,500, incorporated herein by reference. Cage 36 can be omitted from the mold chamber whereby the concrete pipe has a continuous non-reinforced wall.

A vertically movable core indicated generally at 37 and a counter rotating packerhead assembly indicated generally at 38 are concurrently used to a form concrete pipe 100 within mold 24. Counter rotating packerhead assembly operates to distribute and prepack concrete 98 adjacent the inside of mold 24 without twisting cage 36 to minimize voids in the concrete pipe. Vibrating core 37 consolidates the prepacked concrete and makes a smooth finish to the inside surface of concrete pipe 100.

Figure 8:
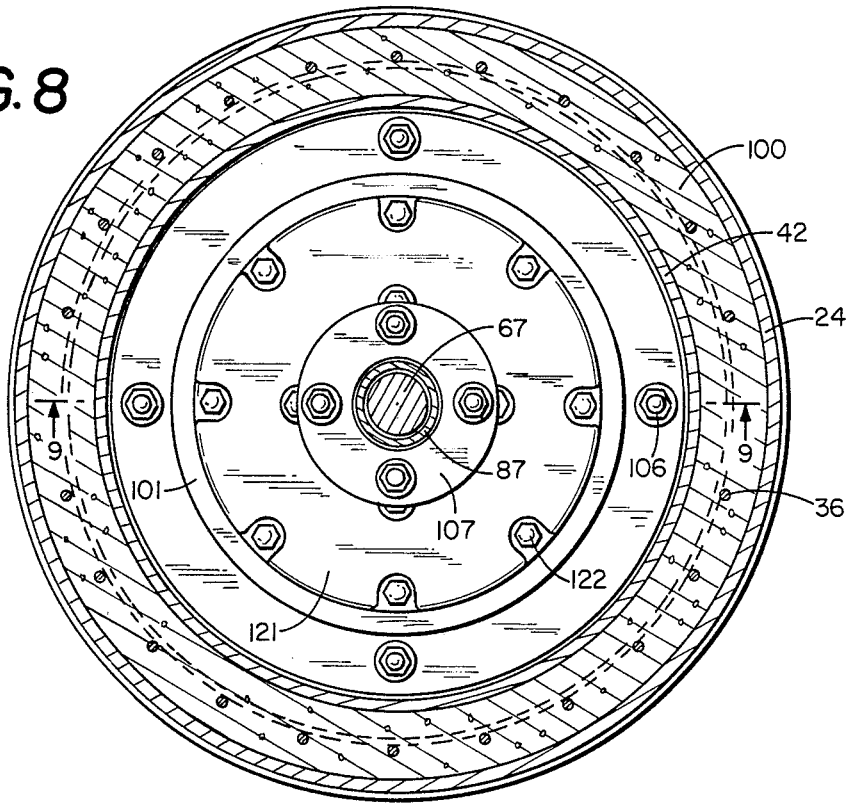
FIG. 8 is a sectional view taken along the line 8—8 of FIG. 4.

A vertical lift structure, shown as a double acting hydraulic cylinder 39 is connected to core 37 with an upright piston rod 41. The lift structure shown in FIG. 1 has a horizontal lift platform 52 supporting the lower end of core 37. Hydraulic cylinders 39 attached to opposite sides of the lift platform 52 are used to selectively raise and lower core 37 and packerhead essembly 38 relative to mold 24. A pair of upright guide rods 53 and 54 attach to frame 12 are located adjacent the corners of platform 52. Sleeves 56 and 57 secured to platform 52 are located about rods 53 and 54 to guide platform 52 and core 37 for vertical movements. A plurality of resilient pads or supports 58 are interposed between the bottom of core 37 and platform 52 to reduce transfer of vibrations from core 37 to platform 52. Cylinder 39 is operable to move core 37 and counter rotating packerhead assembly 38 in an upwardly direction into mold 34 to form concrete pipe 100. After concrete pipe 100 is completed cylinder 39 is retracted to move core 37 and packerhead assembly 38 to a location below turntable 22. Core 37 has a cylindrical wall 42 that shapes the inside surface of the concrete pipe. Wall 42 can have other cross sectional shapes, such as oval, square, rectangular, triangular. The shape of wall 42 conforms to the shape of the inside of mold 24 and is generally concentric therewith. As shown in FIG. 8, cylindrical wall 42 is spaced inwardly from the cylindrical inside surface of mold 24 to define an annular space that accomodates the concrete and cage 36 an determines the shape of the finished concrete pipe.

Figure 4:
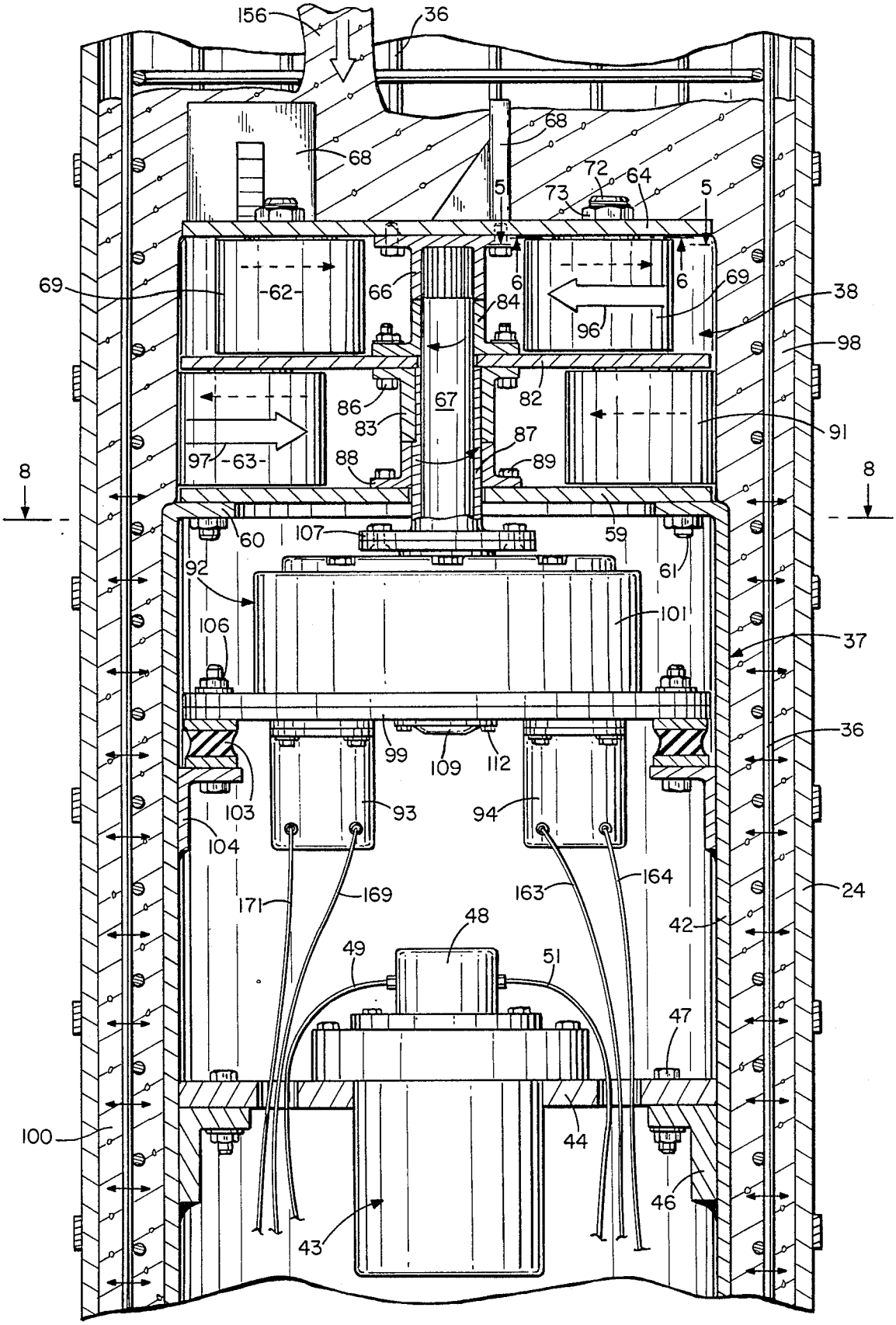
FIG. 4 is an enlarged sectional view taken along the line 4—4 of FIG. 3.

As shown in FIG. 4, a vibrator indicated generally at 43, is located within with the space surrounded by wall 42. Vibrator 43 is mounted on a plate 44 secured to brackets 46 with bolts 47. Brackets 46 are attached with welds to the inside of cylindrical wall 42. Vibrator 43 is driven with a hydraulic motor 48 connected to hydraulic fluid lines 49 and 51 for carrying hydraulic fluid under pressure between motor 48 and a source of pressurized hydraulic fluid, such as a pump (not shown). An example of a vibrator used with a core in a concrete pipe making machine is shown by Fosse et al in U.S. Pat. No. 3,948,354, incorporated herein by reference. The frequency and amplitude of the vibrations generated by vibrator 43 can be regulated by altering the speed of hydraulic motor 48. Control valves (not shown) are used to regulate the rate of flow of hydraulic fluid to motor 48 thereby controlling its operational speed. A programable computer controller 179 can be used to control the valve for motor 48 so that core 37 generates programed vibrations during the forming of the concrete pipe.

Returning to FIG. 2, core 37 is shown as moving up into mold 24 to form a concrete pipe 100. As core 37 moves toward the upper end of mold 24 the amount of concrete surrounding core 37 increases. The concrete around core 37 dampens vibrations generated by core 37 in proportion to the amount of concrete around core 37. The vibration frequency of vibrator 43 is increased as core 37 moves up into the chamber of mold 24 to compensate for the dampening effect of the amount of concrete around core 37 to ensure that the upper section of the concrete pipe is sufficiently consolidated so that the pipe has substantially uniform density throughout the length thereof. The frequency of the vibrations generated by vibrator 43 can remain constant as packerhead assembly 38 and core 37 are moved upwardly into mold chamber to make a concrete pipe.

Figure 9:
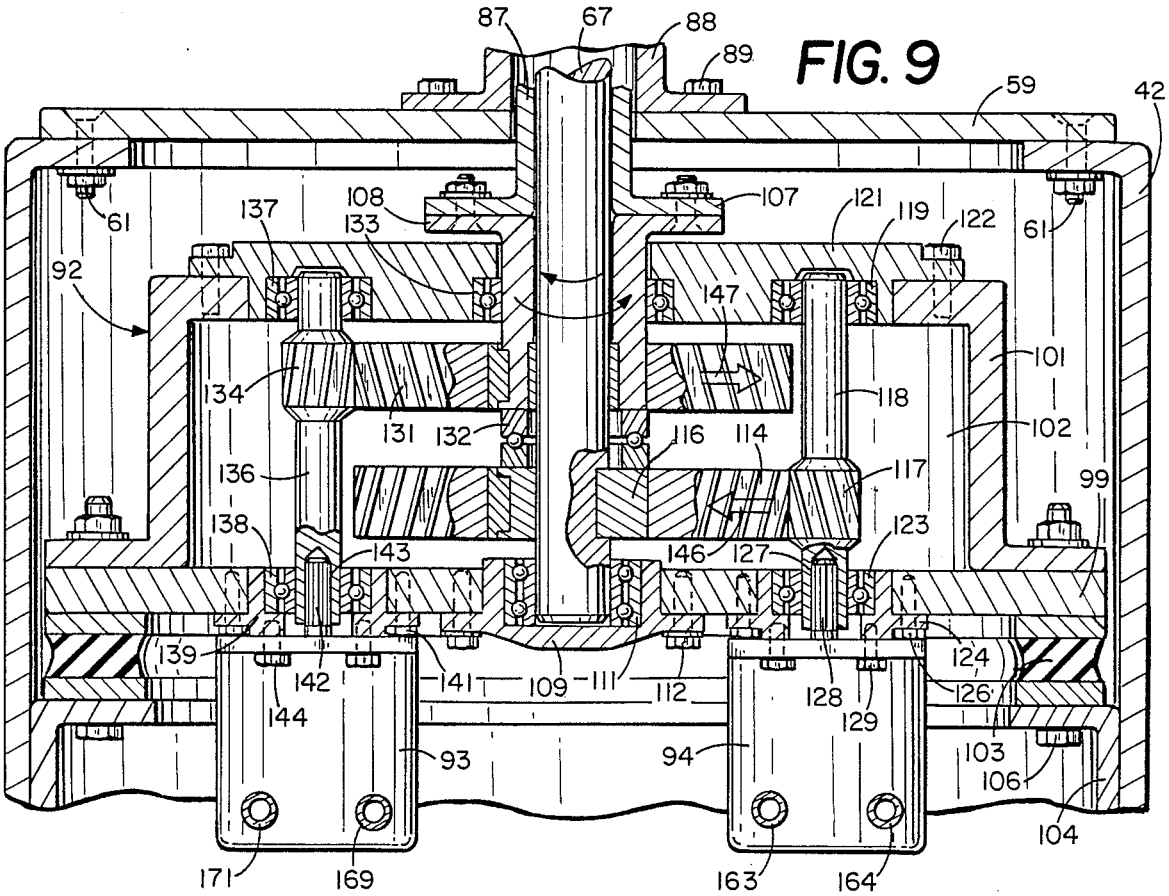
FIG. 9 is a sectional view taken along the line 9—9 of FIG. 8.

As shown in FIGS. 8 and 9, the top of core 37 is closed with a circular plate 59 having a center hole. A plurality of bolts 61 secure plate 59 to an inwardly directed flange on the upper end of core wall 42. Other structures can be used to close the upper end of core 37.

As shown in FIGS. 2 and 4, counter rotating packerhead assembly 38 mounted on top of core 37 has an upper roller head 62 and a lower roller head 63 that are driven in counter or opposite circumferential directions as indicated by arrows 96 and 97. Packerhead assembly 38 can have counter rotating annular trowels with circumferential arranged shoes or solid trowels in lieu of the rollers on the upper and lower roller heads 62 and 63. An example of a packerhead having annular trowels is disclosed by Fosse in U.S. Pat. No. 4,407,648, incorporated herein by reference. Alternatively, packerhead assembly 38 can be provided with a roller head and an annular trowel operable to rotate in opposite directions. Also, each roller head can have rollers and annular trowels. The term "packerhead assembly" as used herein includes, but is not limited to, these counter rotating packerhead structures.

Figure 7:
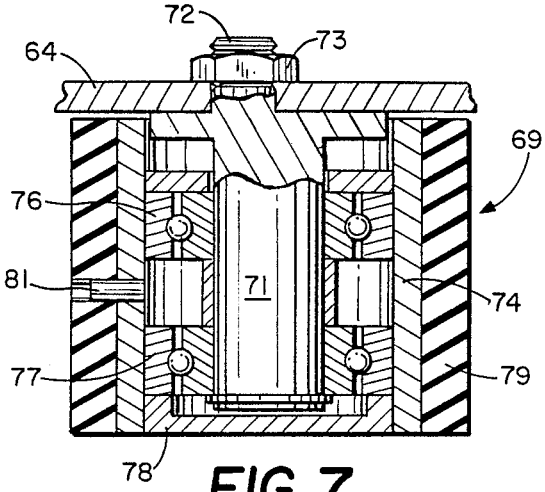
FIG. 7 is a sectional view taken along the line 7—7 of FIG. 5.

The counter rotating upper and lower roller heads 62 and 63 work concrete 98 in the prepack area in opposite directions and minimize twisting forces on cage 35 during the forming of the concrete pipe. Upper roller head 62 has a circular top plate 64 attached to a vertical drive shaft 67 with a hub 66. A plurality of upwardly directed paddles or fins 68 are mounted on top of plate 64. On rotation of the upper roller assembly 62 fins 68 move the concrete outwardly into the prepacked area 98 around roller head 38. A plurality of cylindrical rollers 69 located below plate 64 are mounted on plate 64. Rollers 69 are circumferentially spaced from each other around plate 64. Upper roller head 62 is shown as having four rollers. Additional or fewer rollers can be used with upper roller head 62. As shown in FIG. 7, a generally upright post or axle 71 extends below plate 64. Post 71 has an upright off center stud 72 that extends through a hole in plate 64. A nut 73 threaded on stud 72 secures post 71 to plate 64. The radial position of roller 69 relative to plate 74 can be adjusted by turning stud 72 as it is offset from the vertical axis of post 71. This adjustment is illustrated by the arrow in FIG. 6. All rollers have similar adjusting structures. Roller 69 has cylindrical member such as a metal sleeve 74 that surrounds post 71. The plurality of bearings 76 and 77 rotatably mount cylindrical member 74 on post 71. A cap 78 inserted into the bottom of cylindrical member 74 prevents foreign materials from interferring with the operation of bearings 76 and 77. An elastic sleeve 78, such as a rubber sleeve, is mounted on the cylindrical member 74. A pin 81 holds sleeve 79 in assembled relation with member 74. The elastic sleeve 79 does not slide on the concrete and is not easity stopped. Roller 69 will continue to rotate when used with a wide range of concrete mixes. An example of a concrete packing roller having an elastic sleeve is shown by Haddy in the U.S. Pat. No. 4,690,631, incorporated herein by reference. Each roller can have a conventional metal outer sleeve in lieu of elastic sleeve 79. Other hard and wear resistant materials, such as plastic, ceramics and the like, can be used to make the outer sleeve of the roller.

Lower roller head 63 has a circular second plate 82 located below rollers 69. A collar 83 secured to the bottom of plate 82 is keyed to a tubular sleeve or shaft 87 that surrounds the drive shaft 67. Sleeve 87 is rotatably mounted on bearing 88 secured with bolts 89 to the top plate 59 of core 37. A plurality of cylindrical rollers 91 are located below plate 82 and are mounted thereon. Rollers 91 are circumferentially spaced around plate 82. Each of the rollers 91 has a axle or post that is attached with a nut recessed in plate 82. The rollers 91 each have an outer sleeve of elastic material that corresponds to sleeve 79 shown in FIGS. 5 and 7. Each roller can have a conventional metal outer sleeve in lieu of elastic sleeve 79. Other hard and wear resistant materials, such as plastic, ceramics and the like, can be used to make the outer sleeve of the roller. Lower roller head 63 has four rollers. Additional or fewer rollers can be used with roller assembly 63. Rollers 69 and 91 rotate about their axes in the directions indicated by the broken line arrows in FIGS. 4 as roller heads 62 and 63 turn in opposite directions.

Counter rotating packerhead assembly 38 has a outside circumferential dimension having a diameter that generally is less then the diameter of the wall 42 of core 37. As shown in FIG. 4, the concrete 98 in the annular space in the prepacked area for the concrete has a thickness that is greater than the thickness of the concrete pipe 100 between wall 42 of core 37 and the inside surface of mold 24.

Counter rotating packerhead assembly 38 is powered with a power transmission indicated generally at 92 located within core 37 below top plate 59. Power transmission 92 is operated with two hydraulic motors 93 and 94 to continuously rotate the upper and lower roller heads 62 and 63 in opposite circumferential directions as indicated by arrows 96 and 97 in FIG. 4. Power transmission 92 has a base 99 that carries a housing 101 surrounding a chamber 102. A plurality of shock absorbing pads 103 mount base 99 and housing 101 on a plurality of brackets 104 secured to the inside of wall 42. As shown in FIG. 9, bolts 106 secure pads 103 and base 99 to brackets 104.

As shown in FIGS. 4 and 8, a coupling 17 is connected to power output sleeve 108 of transmission 92. Shaft 67 is rotatably mounted on sleeve 108 and a bearing 111 in a cap 109. Bolts 112 secure cap 109 to base 99. Transmission 92 has a first driven gear 114 keyed to a hub 116 that is secured to the lower end of shaft 67 with a key or the like. A drive gear 117 on a shaft 118 has angled teeth that mesh with angled teeth of gear 114. A bearing 119 accomodates the upper end of shaft 118 and is mounted on a cover 121 secured with bolts 122 to the top of housing 101. A second bearing 123 located on a support 124 accomodates the lower end of shaft 118. The plurality of bolts 126 secure support 124 to base 99. The lower end of shaft 118 has a pocket 127 that accomodates the drive shaft 128 of hydraulic motor 94. Pocket 127 and drive shaft 128 have cooperating drive structure, such as internal and external splines, to driveably couple the motor 94 to shaft 118. A plurality of bolts 129 secure motor 94 to support 24.

A second driven gear 131 is mounted on output sleeve 108 and secured thereto with a key, splines or the like. A bearing 132 separates gear 131 from gear 114. A second bearing 133 rotatably mounts output sleeve 108 on cap 121. A drive gear 134 on shaft 136 has angled teeth that mesh with angled teeth on driven gear 131. The upper end of shaft 136 is rotatably mounted in a bearing 137 mounted on cover 131. The lower end of shaft 136 is rotatably mounted on a bearing 138 carried by a support 139. The plurality of bolts 141 secure support 139 to base 99. The lower end of shaft 136 has a pocket 143 that accomodates drive shaft 142 of hydraulic motor 93. Pocket 143 and drive shaft 142 have cooperating drive structures, such as splines, that driveably connect shaft 142 with shaft 136. A plurality of bolts 144 secure hydraulic motor 93 to support 139. On operation of hydraulic motor 94 the drive gear 117 operates to rotate the driven gear 114 in the direction of arrow 146. This rotates upper roller head 38 in the direction of arrow 96 as seen in FIG. 4. The speed of operation of hydraulic motor 94 can be altered to change the speed of rotation of roller head 62. The hydraulic motor 93 operates to rotate the drive gear 134 to rotate driven gear 131 in the direction of arrow 147. This rotates the lower roller head 63 in the direction of arrow 97 as shown in FIG. 4. The speed of operation of hydraulic motor 93 can be regulated to change the speed of rotation of the lower roller head 63. Preferably, the speed of rotation of lower roller head 63 is a selected and remains substantially constant during the operation of the machine.

Counter rotating packerhead assembly 38 can be powered by a power transmission driven with a single motor or power source. The transmission can have a reverse gear connected to one of the roller heads so that the single motor operates to drive the upper and lower roller heads in opposite rotational directions.

Returning to FIG. 2, mold 24 is supplied with concrete from a conveyer indicated generally at 148. Conveyer 148 is mounted on the top end members 19 and 21 of the frame and has an upwardly open hopper 149 for accomodating a supply of concrete 151. An elongated trough having a endless belt 152 is located below hopper 149 for transporting a ribbon 156 of concrete to top table 26 which directs the concrete into the mold chamber. Belt 152 is trained about a drive pulley 153. A hydraulic motor 154 operates to rotate pulley 153 and thereby move belt 152 in the direction of the arrow 155. Hydraulic fluid under pressure is supplied to motor 154 by a pump 157. Lines or hoses 158 and 159 carry the fluid to and from hydraulic motor 154. A solenoid operated proportional valve 160 interposed in lines 158 and 159 controls the speed of the operation of hydraulic motor 154 and thereby regulate the rate of discharge of concrete into the mold chamber. A valve driver board 180 is wired to the solenoids of valve 160 and computer controller 179 whereby command signals from controller 179 operates valve 160 to control the speed of conveyor 148. Valve 160 has a movable spool coupled to the solenoids and a spool position sensor or linear variable differential transducer 165 wired to driver board 180. Transducer 165 sends a feedback signal to driver board 180 to monitor the position of the spool and reposition the spool to obtain the required flow of hydraulic fluid through the valve whereby the flow of hydraulic fluid is in accordance with the command signals from computer controller 179.

Hydraulic motors 93 and 94 are driven by two separate variable volume pumps 162 and 168 shown in FIG. 2. Pump 162 is connected to line 163 for delivering hydraulic fluid under pressure to motor 94. Line 164 returns hydraulic fluid from motor 94 to a tank. An electric motor 166 drives pump 162. Motor 166 is coupled to a power transducer 167 that senses the electric power used by motor 166 which is responsive to the load on pump 162. The load on pump 162 is directly proportional to the packing force of top roller head 62. Power transducer 167 provides motor load signals to controller 179. Power transducer 167 is a Hall effect watt transducer which generates an analog motor load output signal voltage varying between 0 and 10 volts. A representative power transducer is marketed by Ohio Semitronics, Inc. of Columbus, Ohio. Alternatively, a power transducer can be used to sense the electric power used by motor 172 to provide signals to controller 179 in lieu of power transducer 167. Further, a second power transducer operable to sense the electric power used by motor 172 to provide signals to controller 179 can be used with power transducer 167. Controller 179 uses both signals to control the operation of conveyer 148. When a single motor is used to drive the packerhead assembly 38, a power transducer will sense the total power used to rotate the packerhead assembly 38 and provide a total power signal. The total power signal is used by the controller 179 to control the speed of operation of conveyer 148.

A second variable volume pump 168 is coupled to a line 169 leading to the hydraulic motor 63. A fluid return line 171 coupled motor 93 to a return tank. An electric motor 172 drives pump 168. The output flow of hydraulic fluid from pump 168 is regulated to control the speed of motor 93 thereby controlling the rotational speed of bottom roller head 63. The flow of hydraulic fluid from pump 168 can be preset whereby the speed of motor 93 will be substantially constant.

A variable volume pump 173 diven with an electric motor 177 supplies hydraulic fluid under pressure via line 174 to core lift cylinders 39. A return line 176 carries a fluid from cylinders 39 back to the reservoir for pump 173. A proportional valve 178 interpossed in lines 174 and 176 controls the supply of fluid under pressure to cylinders 39 therefore controlling the direction of movement of the core 37 as well as the speed of the movement of the core 37 as it moves vertically relative to mold 24. A valve driver board 182 is wired to the solenoids of valve 178 and computer controller 179 whereby command signals from controller 179 operates valve 178 to control the speed of movement of core 37. Valve 178 has a movable spool coupled to the solenoids and a spool position sensor or linear variable differential transducer 183 wired to driver board 182. Transducer 183 sends a feedback signal to driver board 182 to monitor the position of the spool and reposition the spool to obtain the required flow of hydraulic fluid through valve 178 whereby the flow of hydraulic fluid is in accordance with the command signals from computer controller 179.

Referring to FIG. 2, the control system indicated generally at 175 for the machine has a programable computer controller 179 that generates output command signals which operate machine controls 181, such as automatic cycling of the operations including operating top table wiper, bell feed and stopping the concrete feed at the top of the pipe as is known in the art. Controller 179 is wired to valve driver boards 180 and so that command signals from controller 179 control the operation of valves 178 and 160 thereby control the speed of conveyor 148 and amount of concrete being discharged into mold 24 and control the lift speed of core 37 and counter rotating packerhead assembly 38 mounted thereon. The rate of vertical movement of core 37 and counter rotating packerhead assembly 38 is correlated with the speed of operation of conveyer 148 to overcome excessive overpack and underpack conditions and thereby ensure substantially uniform concrete compaction and density throughout the length of te pipe. A representative computer controller is marketed by the Allen Bradley Company of Milwaukee, Wis. as an Allen Bradley PLC Family controller. Other types and models of programmable computers can be used in control system 175.

Figure 11:
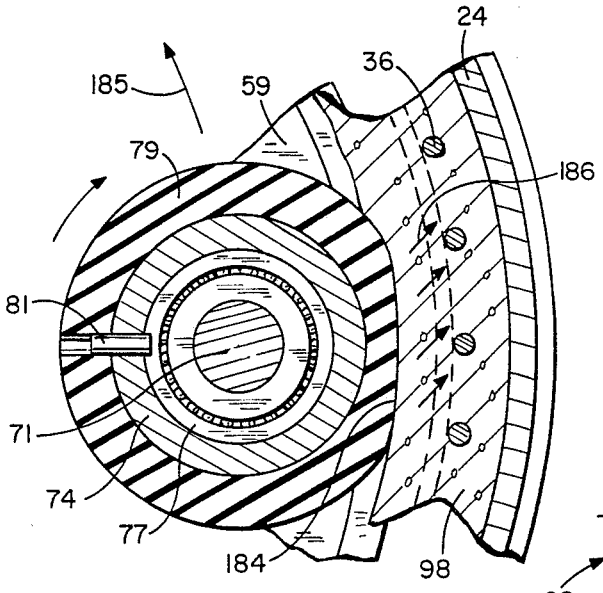
FIG. 11 is a sectional view taken along the line 11—11 of FIG. 10.
Figure 12:
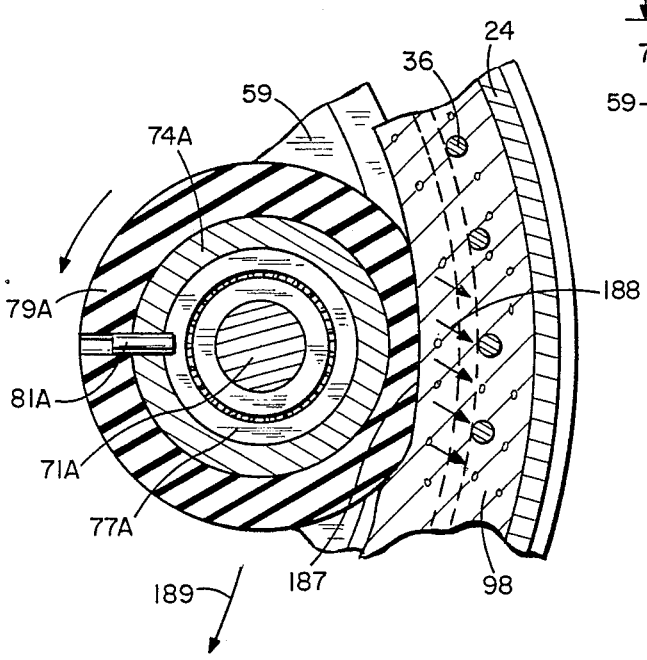
FIG. 12 is a sectional view taken along the line 12—12 of FIG. 10.
Figure 10:
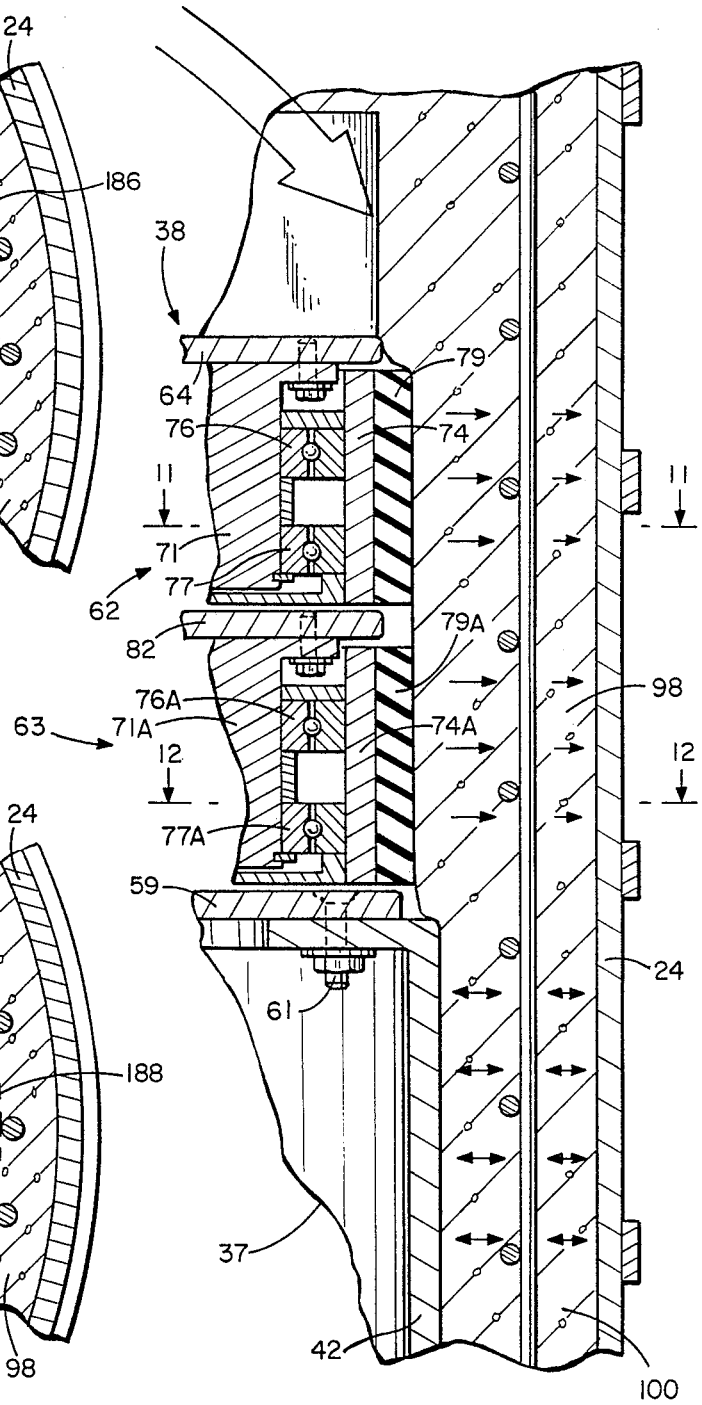
FIG. 10 is an enlarged sectional view taken along the line 10—10 of FIG. 3 showing upper and lower rollers in vertical alignment.

In use, mold 24 provided with cage 36 is placed on the pallet 31 resting on turntable 22. Cage 36 is not used for a non-reinforced concrete pipe. The turntable 22 is rotated to locate mold 24 in the pipe making position as shown in FIG. 1. The top of mold 24 is located in alignment with top table feeding device 27 incorporated into feeding platform 26. The bell end of mold 24 is located in alignment with opening 32 in turntable 22 as shown in FIG. 2. Core 37 is initially raised by operation of hydraulic cylinders 39 to locate the counter rotating packerhead assembly 38 in the bell section of mold 24. Pumps of 162 and 168 are then operated to rotate the upper and lower roller heads 62 and 63 respectively in opposite directions. Conveyer 148 is then operated with motor 154 to deliver concrete 156 to packerhead essembly 38. Packerhead assembly 62 moves and packs the concrete in the bell section of the pipe. When the power on upper roller head 38 attains a selective power as sensed power transducer 167, the programable computer controller 179 signals the valve driver board 182 to operate valve 178 to supply hydraulic fluid under pressure to cylinders 39 and commence the movement of core 37 up into mold 24. Conveyer 149 continuously supplies concrete 156 into mold 24 above packerhead assembly 38. Vibrator 147 is operated on the commencement of the movement of core 37 up into mold 24. The counter rotating packerhead assembly 38 distributes and prepacks the concrete in annular area 98 around packerhead assembly 38 to initially form the concrete in a cylindrical or pipe configuration. The counter rotating roller heads 62 and 63 minimize the circumferential twist on cage 36 and work the concrete around cage 36 as indicated by arrows 186 and 188 in FIGS. 11 and 12. The resilient sleeves 79 and 79A on the rollers of the upper and lower roller heads 62 and 63 are deformed into surface engagement as indicated at 184 in FIGS. 11 and 187 in FIG. 12 to apply surface packing forces on the concrete as the rollers move in opposite circumferial directions as indicated by arrows 185 and 189 and rotate in opposite directions. The counter rotating packerhead assembly 38 prepacks the concrete prior to compression and vibration of the concrete adjacent the outside of cylindrical wall 42 of core 37. As core 37 moves up into mold 24 vibrator 42 operated with a hydraulic motor 48 vibrates wall 42 thereby subjects the concrete between wall 42 and mold 24 to vibrations as shown by the arrows in FIG. 10. These vibrations densify the concrete and insure bonding contact of the concrete with cage 36. As the core 37 moves up into mold 24 the concrete in the lower portions of mold 24 will dampen the vibrations of cylindrical wall 42. Controller 179 is programed to increase the speed of operation of vibrator 43 to increase the amplitude and frequency of the vibrations that are subjected to the concrete in the middle and upper sections of mold 24 as core 37 moves to the top of the mold to compensate for the dampening effect of the concrete around core 37.

Returning to FIG. 2, the speed on conveyer 148 is controlled by hydraulic motor 154. When there is an oversupply of concrete above packerhead assembly 38 the power used by motor 166 for operating pump 162 which supplies the hydraulic fluid under pressure to motor 94 will increase. This increase in power is sensed by power transducer 167. The power transducer 167 signals controller 179 which in turn signals the valve driver board 180 to change the position of solenoid valve 160 to reduce the operating speed of motor 154. This reduces the supply of concrete to mold 24. In the event that there is an under supply of concrete above packerhead assembly 38 the power for operating pump 162 will be reduced. This reduction in power used by motor 166 is sensed by power transducer 167 which in turn signals controller 179. Controller 179 in turn signals valve driver board 180 to increase the speed of operation of motor 154 and thereby increase the amount of concrete that is delivered to mold 24 above packerhead assembly 38. The control system 175 automatically operates to maintain a predetermined supply of concrete above the counter rotating packerhead assembly 38 so that packerhead assembly 38 and core 37 will have a continuous supply of concrete to form the pipe in mold 24 which is subjected to substantial uniform packing force. Controller 179 is programed to operate valves 178 and 180 when the signal from power transducer 167 exceeds selected maximum and minimum values when compared to a selected value.

Core 37 continues to move upwardly in mold 24 to move the packerhead assembly 38 through top table 26. The concrete carried by the packerhead assembly 38 is temporarily stored on table top 26. The table top wiper 29 is subsequently operated to move the concrete from top table 26 back into mold 24.

When the pipe is completed conveyer 148 is stopped. The core 37 and packerhead 38 are moved down to their initial position below turntable 22. Turntable 22 is then rotated to move mold 24 to the off bearing position. Mold 23 is then moved into the pipe forming position wherein the operation is repeated to make a second concrete pipe.

Figure 13:
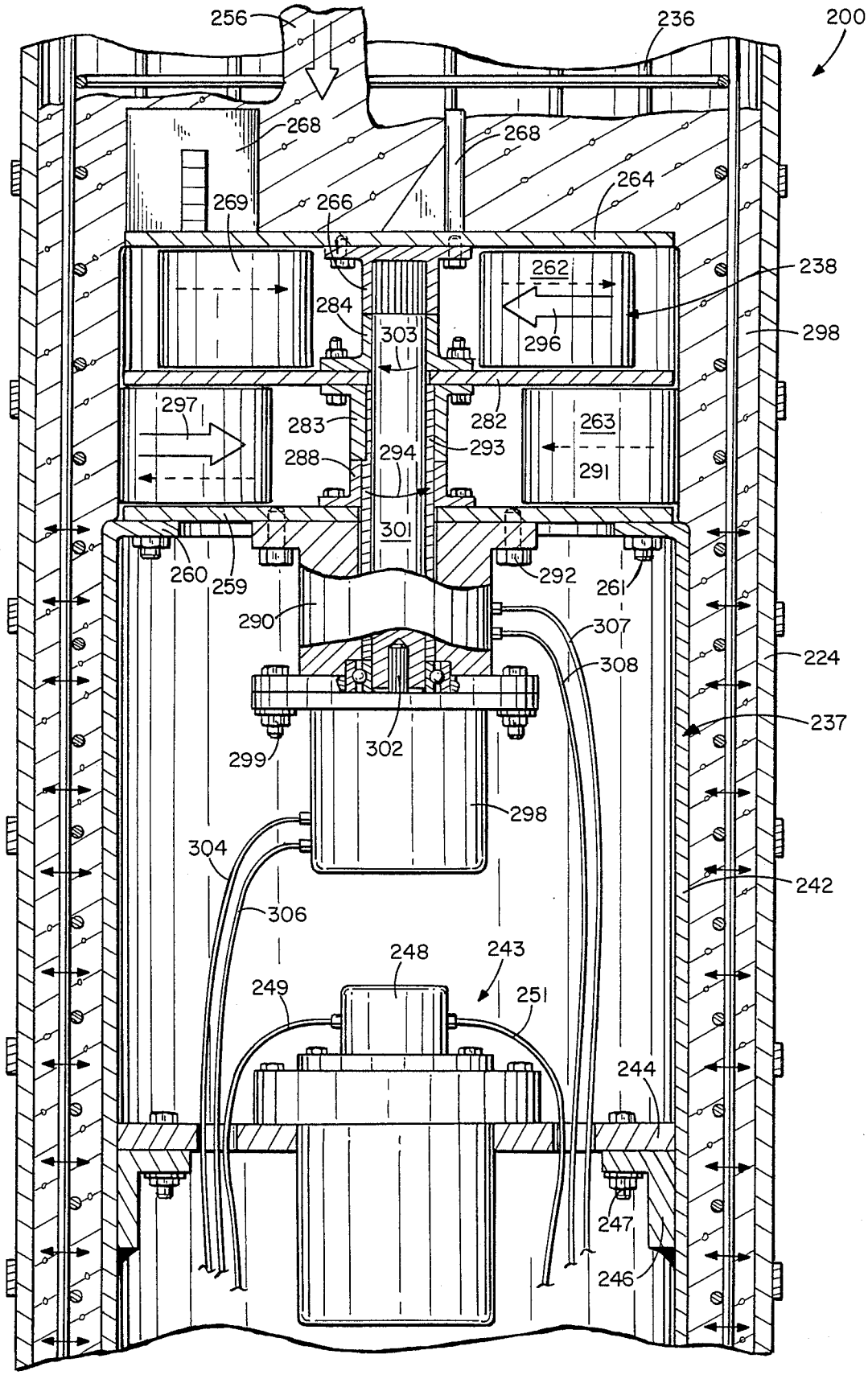
FIG. 13 is a longitudinal sectional view similar to FIG. 4 of a modification of the drive motors for the counter rotating roller assembly mounted on top of the vibrating core.

Referring to FIG. 13, there is shown a modification of the concrete pipe making machine and particularly the drive for the counter rotating packerhead assembly 238. The parts of the machine of FIG. 13 that correspond to the machine of FIGS. 1 to 12 have the same reference numeral with the prefix "2". FIG. 13 is a longitudinal sectional view through mold 224 that is similar to FIG. 4. A cage 236 is located within mold 224 to reinforce the concrete pipe. Concrete pipe can be made without cage 236. A cylindrical core 237 having a diameter smaller than the diameter of core 37 is adapted to move up into mold 224 to form the concrete pipe. The counter rotating rollerhead assembly 238 is position on top of core 237 to prepack the concrete in the annular area 298 for subsequent vibration action and forming with core 237. Core 237 has a cylindrical wall 242 having a diameter smaller than diameter of mold 224. A vibrator 243 is located in the central portion of upper end of core 237. Vibrator 243 is constructed according to the vibrator of U.S. Pat. No. 3,948,354 and is supported on a generally horizontal plate 244 carried on brackets 246 and secured thereto with a plurality of bolts 247. Vibrator 243 has a fluid motor 248 that is connected to fluid lines 249 and 251 operable to deliver hydraulic fluid under pressure to motor 248 and thereby operate vibrator 243 at selected speeds.

Figure 5:
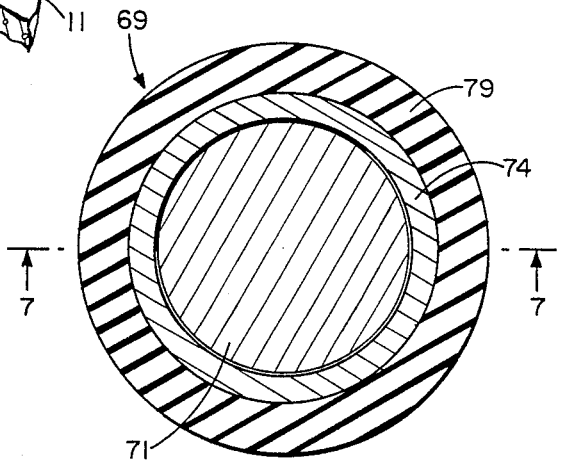
FIG. 5 is an enlarged sectional view taken along the line 5—5 of FIG. 4.
Figure 6:
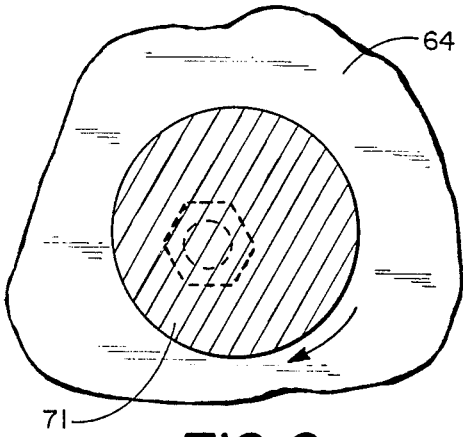
FIG. 6 is an enlarged sectional view taken along the line 6—6 of FIG. 4.

The top of cylindrical wall 242 is connected to a plate or cover 259 that supports the counter rotating roller head assembly 238. Packerhead assembly 238 has an upper roller head 262 and a lower roller head 263. Upper roller head 262 has a top plate 264 carrying a plurality of upwardly directed paddles 268 which move concrete generally radial direction into annular space 298 surrounding packerhead assembly 238. Upper roller head 262 has a plurality of cylindrical rollers 269 that are constructed according to roller 69 as shown in FIGS. 5, 6, and 7. Lower roller head 263 also has a plurality of cylindrical rollers 291 that are constructed according to the rollers 69 as shown on FIGS. 5, 6, and 7.

The upper and lower roller heads 262 and 263 are rotated about a common vertical axis in opposite circumferential directions. This rotation is acheived with the use of in line hydraulic motors 290 and 298 that fit within the small core 237. Motor 290 is generally cylindrical motor that is secured with bolts 292 to the bottom of plate 259. Motor 291 drives a sleeve 292 that is connected to hub 283 that drives the lower roller assembly 291 in the direction of arrow 297. A pair of hydraulic fluid carrying lines 307 and 308 supply hydraulic fluid under pressure to motor 291. Lines 207 and 208 are connected to a pump, such as pump 168 and control system 175.

The second hydraulic motor 298 is mounted with bolts 299 on motor 291. The motor 298 drives an upright shaft 301 that is located within sleeve 293 and drivably connected to hub 266 of the upper roller assembly 262. Motor 298 has a splined output shaft 302 that fits into a spline pocket in the lower end of shaft 301. Other types of drive connections can be used between motor 298 and shaft 301. A pair of hydraulic fluid carrying lines 304 and 306 are operable to supply motor 298 with hydraulic fluid under pressure from a pump such as a variable volume pump 162 shown in FIG. 2 that is operatively associated with control system 175 of the machine. The hydraulic fluid motors 291 and 298 are operated to concurrently rotate the upper and lower roller heads 262 and 263 in opposite directions. The power required to rotate the upper roller head 262 is sensed with a power transducer 267 to control the operation of fluid motor 154 used to operate conveyer 148 thereby controlling the level of concrete above the roller head assembly 238. The vibrator 243 is operated to vibrate the cylindrical wall 242 of the core 237 to subject the concrete in the mold 242 to vibrations and thereby densify the concrete pipe. The operation of the modified machine 200 with the control system 175 is the same as machine 10.

Machine 10 has a core 37 and counter rotating packerhead assembly 38 that is moved up into mold chamber with an extendible and contractible lift or hydraulic cylinder 39, 41 to make concrete pipe. An alternative machine having core 37 and counter rotating packerhead assembly 38 includes structure to mount the core 37 on a stationary platform or floor below the discharge end of conveyor 148. The mold is connected to structure, such as hydraulic cylinders, operable to move the mold down over the core as concrete is discharged into the mold by the conveyor 148. The counter rotating packerhead assembly 38 prepacks the concrete in the moving mold and the core when vibrated consolidates and densifies the concrete.

While there has been shown and described perferred embodiments of the concrete pipe making machine having a vibrating core associated with a counter rotating roller head assembly, is understood that changes, modifications, and the structure and materials may be made by those skilled in the art without departing from the invention. The invention is defined in the following claims.

We claim:

1. A machine for making concrete pipe with the use of an upright mold having a generally cylindrical mold side wall surrounding a mold chamber and a generally cylindrical reinforcing cage located within the mold chamber adjacent the mold side wall and a support having an opening for holding a mold over said opening, comprising: a core and counter rotating packerhead means located below said support in vertical alignment with said opening, conveyor means located above said mold for discharging concrete into said mold chamber above said roller head means, said core having a top wall and a cylindrical side wall surrounding a core chamber, said core sidewall having a diameter less than the diameter of said mold side wall providing an annular space accommodating said cage and concrete, vibrator means located within the core chamber, means mounting the vibrator means on said core side wall whereby the vibrator means operates to vibrate said core side wall and concrete adjacent thereto, said counter rotating packerhead means located above said top wall operable to distribute concrete toward said mold side wall and prepack concrete between said mold side wall and said packerhead means, upright shaft means mounting the packerhead means on the core for rotation about the upright axis of the core side wall, said packerhead means comprising an upper roller head and a lower roller head located below the upper roller head, each roller head having a generally circular plate and a plurality of circumferentially arranged rollers rotatably mounted on the plate for rotation about separate axes generally parallel to said upright axis of the core side wall, said rollers each having outer circumferential portions that move along a circular path having a diameter smaller than the diameter of said core side wall whereby said roller prepack the concrete adjacent the mold side wall to a thickness greater than the thickness of the concrete in the space between the core side wall and mold side wall as the rollers move along said circular path, said upright shaft means having a first shaft drivably connected to the upper roller head and a second shaft drivably connected to the lower roller head, first drive means located within said core chamber for turning the first shaft to rotate the upper roller head in a first circumferential direction about said upright axis, second drive means located within said core chamber for turning the second shaft to rotate the lower roller head in a second circumferential direction opposite the first circumferential direction about said upright axis, power means connected to the core for concurrently moving the core and packerhead means mounted on the core through the opening in the support and up into the mold chamber to form a concrete pipe upon operation of the conveyor means to discharge concrete into the mold chamber above the packerhead means, first and second drive means for respectively rotating the upper roller head and lower roller head in opposite circumferential directions to distribute concrete toward the mold side wall and prepack concrete in the space between the packerhead means and mold side wall, and vibrating the core side wall to consolidate the prepacked concrete in the space between the core side wall and mold side wall, said power means subsequently operable to concurrently move the core and packerhead means down out of the mold chamber to allow the mold and concrete pipe therein to be removed from the machine.

2. The machine of claim 1 including: first means for sensing the power used by the first drive means for turning the upper roller head and for generating a signal representative of the sensed power, and second means responsive to said signal to control the speed of operation of the conveyor means and thereby controlling the rate at which concrete is discharged by the conveyor means into the mold chamber.

3. The machine of claim 2 including: means for operating the power means to move the core and packerhead means thereon up into the mold chamber at selected speeds responsive to said signal.

4. The machine of claim 1 including: first means for sensing the power used by the least one of the first or second drive means for turning the counter rotating packerhead assembly and for generating a signal representative of the sensed power, and second means responsive to said signal to control the speed of operation of the conveyor means thereby controlling the rate at which concrete is dispensed by the conveyor means into the mold chamber.

5. The machine of claim 4 including: means for operating the power means to move the core and packerhead means up into the mold chamber at selected speeds responsively to said signal.

6. The machine of claim 1 including: means for operating the power means to move the core and packerhead means mounted thereon up into the mold chamber at selected speeds.

7. The machine of claim 6 wherein: said power means comprises hydraulic cylinder means operable to move said core and packerhead means, pump means for supplying hydraulic fluid under pressure to the cylinder means, valve means for controlling the flow of hydraulic fluid from the pump means to the cylinder means thereby controlling the speed of operation of the cylinder means, and control means connected to the valve means to operate the valve means thereby controlling the speed of the movement of the core and packerhead means into the mold chamber during the forming of the concrete pipe.

8. The machine of claim 7 including: first means for sensing the power used by the first drive means for turning the upper roller head and for generating a signal representative of the sensed power, said control means responsive to said signal to operate the valve means.

9. The machine of claim 8 including: second means responsive to said signal to control the speed of operation of the conveyor means and thereby control the rate at which concrete is discharged by the conveyor means into the mold chamber.

10. The machine of claim 1 wherein: said vibrator means includes a motor for operating the vibrator means at selectecd speeds to vary the vibrations generated by the vibrator means, and control means connected to said motor operable to increase the speed of the vibrator means thereby increasing the vibrations as the core moves up into the mold chamber.

11. The machine of claim 1 wherein: the first drive means includes a motor operable to turn the first shaft to rotate the upper roller head in said first circumferential direction at selected rotational speeds, and control means connected to said motor operable to vary the speed of operation of said motor.

12. The machine of claim 11 wherein: said motor is a hydraulic fluid operated motor, and said control means including a variable volume pump for supplying hydraulic fluid under pressure to said motor, and means to control the hydraulic fluid output of said pump thereby control the speed of operation of the motor.

13. The machine of claim 1 wherein: said first drive means and said second drive means includes a power transmission having a first gear train operably connected to the first shaft connected to the upper roller head and a second gear train operably connected to the second shaft connected to the lower roller head, a first motor for driving the second gear train in a second direction opposite the first direction whereby the upper and lower roller heads are driven in opposite directions.

14. A machine for making concrete pipe with use of an upright mold having a side wall surrounding a mold chamber, a support for holding the mold in an upright position comprising: a core having a top wall and a side wall having an upright axis positioned to be moved upwardly into the mold chamber and downwardly out of the mold chamber, vibrator means mounted on the core operable to vibrate the core side wall, counter rotating packerhead means located above the core top wall to prepack concrete around the packerhead means, shaft means mounting the packerhead means on the core for rotation about the upright axis of the core, said packerhead means comprising a first roller head having a plurality of first rollers and a second roller head having a plurality of second rollers located below the first roller head, drive means located within said core for rotating the shaft means to turn the first roller head in a first circumferential direction and for rotating the second roller head in a second circumferential direction opposite the first circumferential direction to work and prepack the concrete around the packerhead means, power means connected to the core for concurrently moving the core and packerhead means into and out of the mold chamber, and means for directing concrete into the mold chamber above the packerhead means, said packerhead means packing the concrete around the packerhead means adjacent the mold side wall, and said vibrator means vibrating the core and concrete between the core and the mold side wall as the counter rotating packerhead means and core are concurrently moved into the mold chamber to form the concrete pipe.

15. The machine of claim 14 including: first means for sensing the power used by the drive means for turning the first roller head and for generating a signal representative of the sensed power, and second means responsive to said signal to control the speed of operation of the means for directing concrete into the mold chamber and thereby control the rate at which concrete is discharged into the mold chamber.

16. The machine of claim 15 including: means for operating the power means to move the core and packerhead means theron up into the mold chamber at selected speeds responsive to said signal.

17. The machine of claim 14 including: first means for sensing the power used by the drive means for turning at least one of the roller heads and for generating a signal representative of the sensed power, and second means responsive to said signal to control the speed of operation of the means for directing concrete into the mold chamber and thereby control the rate at which concrete is discharged into the mold chamber.

18. The machine of claim 17 including: means for operating the power means to move the core and packerhead means thereon up into the mold chamber at selected speeds responsive to said signal.

19. The machine of claim 14 including: means for operating the power means to move the core and packerhead means mounted thereon up into the mold chamber at selected speeds.

20. The machine of claim 19 wherein: said power means comprises hydraulic cylinder means operable to move said core and packerhead means, pump means for supplying hydraulic fluid under pressure to the cylinder means, valve means for controlling the flow of hydraulic fluid from the pump means to the cylinder means thereby controlling the speed of operation of the cylinder means, and control means connected to the valve means to operate the valve means thereby controlling the speed of the movement of the core and packerhead means into the said chamber during the forming of the concrete pipe.

21. The machine of claim 20 including: first means for sensing the power used by the drive means for turning at least one of the roller heads and for generating a signal representative of the sensed power, said control means responsive to said signal to operate the valve means.

22. The machine of claim 21 including: second means responsive to said signal to control the speed of operation of the means for directing concrete into the mold chamber and thereby controlling the rate at which concrete is discharged into the mold chamber.

23. The machine of claim 14 wherein: said vibrator means includes a motor for operating the vibrator means at selected speeds to vary the vibrations generated by the vibrator means, and control means connected to said motor operable to increase the speed of the vibrator means thereby increasing the vibrations as the core moves up into the mold chamber.

24. The machine of claim 14 wherein: the drive means includes a motor operable to turn the shaft means to rotate the first roller head in said first circumferential direction at selected rotational speeds, and control means connected to said motor operable to vary the speed of operation of said motor.

25. The machine of claim 24 wherein: said motor is a hydraulic fluid operated motor, and said control means including a variable volume pump for supplying hydraulic fluid under pressure to said motor, and means to control the hydraulic fluid output of said pump thereby controlling the speed of operation of the motor.

26. The machine of claim 14 wherein: said shaft means includes a first shaft connected to the first roller head and a second shaft connected to the second roller head, said drive means includes a power transmission having a first gear train operably connected to the first shaft and a second gear train operably connected to the second shaft, a first motor for driving the first gear train in a first direction, and a second motor for driving the second gear train in a second direction opposite the first direction whereby the firsr and second roller heads are driven in opposite directions.

27. A machine for making concrete pipe with use of an upright mold having a side wall surrounding a mold chamber, a support for holding the mold in an upright position, comprising: a core having a top wall and a side wall having an upright axis positioned to be moved upwardly into the mold chamber and downwardly out of the mold chamber, vibrator means mounted on the core operable to vibrate the core, counter rotating concrete working means located above the core top wall to prepack concrete around the concrete working means, shaft means mounting the concrete working means on the core for rotation about the upright axis of the core, said concrete working means comprising a first means for working concrete generally into the shape of a concrete pipe, second means for working the concrete after the first means has worked the concrete, drive means located within said core for rotating the shaft means to turn the first means in a first circumferential direction and for turning the second means in a second circumferential direction opposite the first circumferential direction thereby working the concrete in opposite directions, power means connected to the core for concurrently moving the core and concrete working means into and out of the mold chamber, and means for directing concrete into the mold chamber above the concrete working means, said concrete working means prepacking the concrete around the concrete working means adjacent the mold side wall, and said vibrator means vibrating the core and concrete between the core and the mold side walll as the counter rotating concrete working means and core are concurrently moved into the mold chamber to form the concrete pipe.

28. The machine of claim 27 including: means for sensing the power used by the drive means for turning the first means and for generating a signal representative of the sensed power, second means responsive to said signal to control the speed of operation of the means for directing concrete into the mold chamber and thereby control the rate at which concrete is discharged into the mold chamber.

29. The machine of claim 28 including: means for operating the power means to move the core and counter rotating concrete working means thereon up into the mold chamber at selected speeds responsive to said signal.

30. The machine of claim 27 including: means for sensing the power used by the drive means for turning at least one of the first or second means and for generating a signal representative of the sensed power, and means responsive to said signal to control the speed of operation of the means for directing concrete into the mold chamber and thereby control the rate at which concrete is discharged into the mold chamber.

31. The machine of claim 30 including: means for operating the power means to move the core and counter rotating concrete working means thereon up into the mold chamber at selected speeds responsive to said signal.

32. The machine of claim 27 including: means for operating the power means to move the core and counter rotating concrete working means mounted thereon into the mold chamber at selected speeds.

33. The machine of claim 32 wherein: said power means comprises hydraulic cylinder means operable to move said core and counter rotating concrete working means, pump means for supplying hydraulic fluid under pressure to the cylinder means, valve means for controlling the flow of hydraulic fluid from the pump means to the cylinder means thereby controlling the speed of operation of the cylinder means, and control means connected to the valve means to operate the valve means and thereby control the speed of the movement of the core and counter rotating concrete working means into the mold chamber during the formimg of the concrete pipe.

34. The machine of claim 33 including: means for sensing the power used by the drive means for turning the first means and for generating a signal representative of the sensed power, said control means responsive to said signal to operate the valve means to control the flow of hydraulic fluid from the pump means to the cylinder means.

35. The machine of claim 34 including: means responsive to said signal to control the speed of operation of the means for directing concrete into the mold chamber and thereby control the rate at which concrete is discharged into the mold chamber.

36. The machine of claim 27 wherein: said vibrator means includes a motor for operating the vibrator means selected speeds to vary the vibrations generated by the vibrator means, and control means connected to said motor operable to increase the speed of the vibrator means thereby increasing the vibrations as the core move up into the mold chamber.

37. The machine of claim 27 wherein: the drive means includes a motor operable to turn the shaft means to rotate the first means in said first circumferential direction at selected rotational speeds, and control means connected to said motor operable to vary the speed of operation of said motor.

38. The machine of claim 37 wherein: said motor is a hydraulic fluid operator motor, and said control means including a variable volume pump for supply hydraulic fluid under pressure to said motor, and means to control the hydraulic fluid output of said pump thereby controlling the speed of operation of the motor.

39. The machine of claim 27 wherein: said shaft means includes a first shaft connected to the first means and a second shaft connected to the second means, said drive means includes a power transmission having a first gear train operably connected to the first means and a second gear train operably connected to the second means, a first motor for driving the first gear train in a first direction, and a second motor for driving the second gear train in a second direction opposite the first direction whereby the first and second means for working concrete are driven in opposite directions.

40. A core and counter rotating packerhead assembly for a concrete pipe making machine comprising: a core having an upright axis, a side wall, and a top wall surrounding a chamber, vibrator means located within said chamber, means mounting the vibrator means on the side wall of the core whereby the vibrator means vibrates said side wall, counter rotating packerhead means located adjacent said top wall of the core, shaft means mounting the packerhead means on the core for rotation about the upright axis of the core, said packerhead means comprising a first roller head having a plurality of first rollers and a second roller head having a plurality of second rollers located below the first rollers, and drive means mounted on the core and located in said chamber for rotating the shaft means to turn the first roller head in a first circumferential direction and turning the second roller head in a second circumferential direction opposite the first circumferential direction.

41. The core andd counter rotating packerhead assembly of claim 40 wherein: said vibrator means includes a motor for operating the vibrator means at selected speeds to vary the vibrations generated by the vibrator means.

42. The core and counter rotating packerhead assembly of claim 40 wherein: the drive means includes a motor operable to rotate the shaft means to turn the first roller head means in said first circumferential direction at selected rotational speeds.

43. The core and counter rotating packerhead assembly of claim 40 wherein: said shaft means includes a first shaft connected to the first roller head and a second shaft connected to the second roller head, said drive means includes a first motor for rotating the first shaft turn the first roller head in said first circumferential direction, and a second motor for rotating the second shaft to turn the second roller head in said second circumferential direction independent of the first motor.

44. The core and counter rotating packerhead assembly of claim 40 wherein: said shaft means includes a first shaft connected to the first roller head and a second shaft connected to the second roller head, said drive means includes a power transmission having a first gear train operably connected to the first shaft and a second gear train operably connected to the second shaft, a first motor for driving the first gear train in a first direction and a second motor for driving the second gear train in a second direction opposite the first direction whereby the first and second roller heads are driven in opposite directions.

45. A core and counter rotating packerhead assembly for a concrete pipe making machine comprising: a core having an axis, a side wall, and a top wall surrounding a chamber, vibrator means located within said chamber, means mounting the vibrator means on the side wall of the core whereby the vibrator means vibrates said side wall, counter rotating packerhead means located adjacent said top wall of the core, shaft means mounting the packerhead means on the core for rotation about the axis of the core, said packerhead means, comprising a first means for working concrete generally into the shape of a concrete pipe, second means for working the concrete after the first means has worked the concrete, and drive means mounted on the core and located in said chamber for rotating the shaft means to turn the first means in a first circumferential direction and turn the second means in a second circumferential direction opposite the first circumferential direction.

46. The core and counter rotating packerhead assembly of claim 45 wherein: said vibrator means includes a motor for operating the vibrator means at selected speeds to vary the vibrations generated by the vibrator means.

47. The core and counter rotating packerhead assembly of claim 45 wherein: the drive means includes a motor operable to rotate the shaft means to turn the first means in said first circumferential direction at selected rotational speeds.

48. The core and counter rotating packerhead assembly of claim 45 wherein: said shaft means include a first shaft connected to the first means and a second shaft connected to the second means, said drive means includes a first motor for rotating the first shaft to turn the first means in said first circumferential direction, and a second motor for rotating the second shaft to turn the second means in said second circumferential direction independent of the first motor.

* * * * *